US007182049B2

(12) United States Patent
Wikstrom

(10) Patent No.: US 7,182,049 B2
(45) Date of Patent: Feb. 27, 2007

(54) COOLING ARRANGEMENT AND A METHOD FOR COOLING A VEHICLE ENGINE RETARDER

(75) Inventor: Hans Wikstrom, Johanneshov (SE)

(73) Assignee: Scania CV AB (publ) (SE)

( * ) Notice: Subject to any disclaimer, the term of this patent is extended or adjusted under 35 U.S.C. 154(b) by 0 days.

(21) Appl. No.: 10/551,042

(22) PCT Filed: Mar. 10, 2004

(86) PCT No.: PCT/SE2004/000352

§ 371 (c)(1),
(2), (4) Date: Sep. 27, 2005

(87) PCT Pub. No.: WO2004/085807

PCT Pub. Date: Oct. 7, 2004

(65) Prior Publication Data

US 2006/0213463 A1 Sep. 28, 2006

(30) Foreign Application Priority Data

Mar. 28, 2003 (SE) ..... 0300923

(51) Int. Cl.
*F01P 3/20* (2006.01)

(52) U.S. Cl. ..... 123/41.31; 123/41.33

(58) Field of Classification Search ..... 123/41.31, 123/41.33

See application file for complete search history.

(56) References Cited

U.S. PATENT DOCUMENTS

| | | | | |
|---|---|---|---|---|
| 4,430,966 | A * | 2/1984 | Marandet et al. | 123/41.1 |
| 4,620,509 | A * | 11/1986 | Crofts | 123/41.1 |
| 6,546,899 | B1 * | 4/2003 | Friedrich et al. | 123/41.31 |
| 2003/0033993 | A1 * | 2/2003 | Valaszkai et al. | 123/41.31 |

FOREIGN PATENT DOCUMENTS

| | | |
|---|---|---|
| DE | 37 00 037 A1 | 7/1988 |
| DE | 101 38 704 A1 | 3/2003 |
| EP | 0 873 926 A2 | 10/1998 |
| WO | WO 95/01500 | 1/1995 |

* cited by examiner

*Primary Examiner*—Stephen K. Cronin
*Assistant Examiner*—Jason Benton
(74) *Attorney, Agent, or Firm*—Ostrolenk, Faber, Gerb & Soffen, LLP

(57) ABSTRACT

Cooling device for a retarder of a vehicle engine, comprising a coolant circuit with a coolant cooler and a retarder cooler, and at least one further coolant circuit with a further coolant cooler and a further cooler. To allow more cooling capacity to be released for the retarder when the latter is activated, the cooling device has valves arranged to connect the coolant circuits together upon activation of the retarder so that at least two coolant coolers are then used for cooling the retarder, and to disconnect the coolant circuits from one another so that they revert to being separate circuits upon deactivation of the retarder.

8 Claims, 5 Drawing Sheets

COOLING ARRANGEMENT AND A METHOD FOR COOLING A VEHICLE ENGINE RETARDER

The present application is a 35 U.S.C. §§ 371 national phase conversion of PCT/SE2004/000352, filed 10 Mar. 2004, which claims priority of Swedish Application No. 0300923-0, filed28 Mar. 2003. The PCT International Application was published in the English language.

TECHNICAL FIELD

The invention relates to a cooling device for a retarder of a vehicle engine, comprising a coolant circuit with a coolant cooler and a retarder cooler and at least one further coolant circuit with a further coolant cooler and a further cooler. The invention also relates to a method of cooling a retarder.

STATE OF THE ART

New emission regulations for vehicle engines are resulting in ever greater requirements concerning the cooling of engines, with the result that a larger proportion of engine losses reach the cooling system.

Whereas previously a large proportion of these losses were discharged in exhaust gases, today's strict emission regulations entail the introduction of new techniques, such as EGR (Exhaust Gas Recirculation) whereby even as much as 30% of the exhaust gases are led back to the engine inlet. EGR gases have to be cooled.

An EGR system is often used in conjunction with a charge air system, such as a turbocharger, which is intended to feed as much fresh air as EGR into the engine, with the result that the fresh air has to be pressurized to a very high pressure in the turbocharger. This also means that the charge air will be hotter when it leaves the compressor than was previously the case. Both charge air and EGR gases therefore need cooling effectively so that a sufficiently large mass flow can reach the engine.

High charge air temperature in combination with high charge air pressure means inter alia that a conventional charge air cooler made of aluminum cannot be used because of problems pertaining to that material.

A known practice is this connection is to cool charge air by coolant by means of a separate coolant circuit.

Another known practice is the cooling of EGR gases by means of a separate coolant circuit.

The reason for thus having a further coolant circuit (or possibly two or more further coolant circuits) is that it needs to be at a lower temperature level than the engine cooling circuit. The engine cooling circuit may typically be at about 80–85° C. for good heat transfer around the fluid-cooled cylinder liners and cylinder heads and for ensuring that the engine temperature does not become too high. The further coolant circuit is set at a significantly lower nominal temperature level, about 10° C. above ambient temperature.

As well as meeting the requirements indicated above with regard to greater cooling of vehicle engines, engine and truck manufacturers are also endeavoring to improve the performance of retarders, which in practice means having to improve the cooling performance of retarders.

SUMMARY OF THE INVENTION

One object of the present invention is to further develop a cooling device of the kind indicated in the introduction, so that more cooling capacity can be released for the retarder when the latter is activated.

The insight on which the invention is based is that different engine components have varying mutually complementary cooling requirements, thereby allowing the possibility of distributing the total available cooling capacity according to the requirements of the various components at the time. Particularly during the time when the retarder needs activating to brake the vehicle, engine cooling components such as EGR cooler, charge air cooler, motor oil cooler and engine coolant cooler require less cooling, which means that the cooling capacity otherwise needed for these components can then be also used for cooling the retarder.

One version of the invention has valve means arranged to connect the coolant circuits together upon activation of the retarder in such a way that at least two coolant coolers are then used for cooling the retarder, and to disconnect the coolant circuits from one another so that they revert to being separate coolant circuits upon deactivation of the retarder.

In particular, further valve means may be arranged to disconnect the further cooler from the further coolant circuit upon activation of the retarder and to connect the further cooler to the further coolant circuit upon deactivation of the retarder.

Other features and advantages of the invention are indicated by the claims and the following detailed description of embodiments.

DESCRIPTION OF EMBODIMENTS

Figure 1:
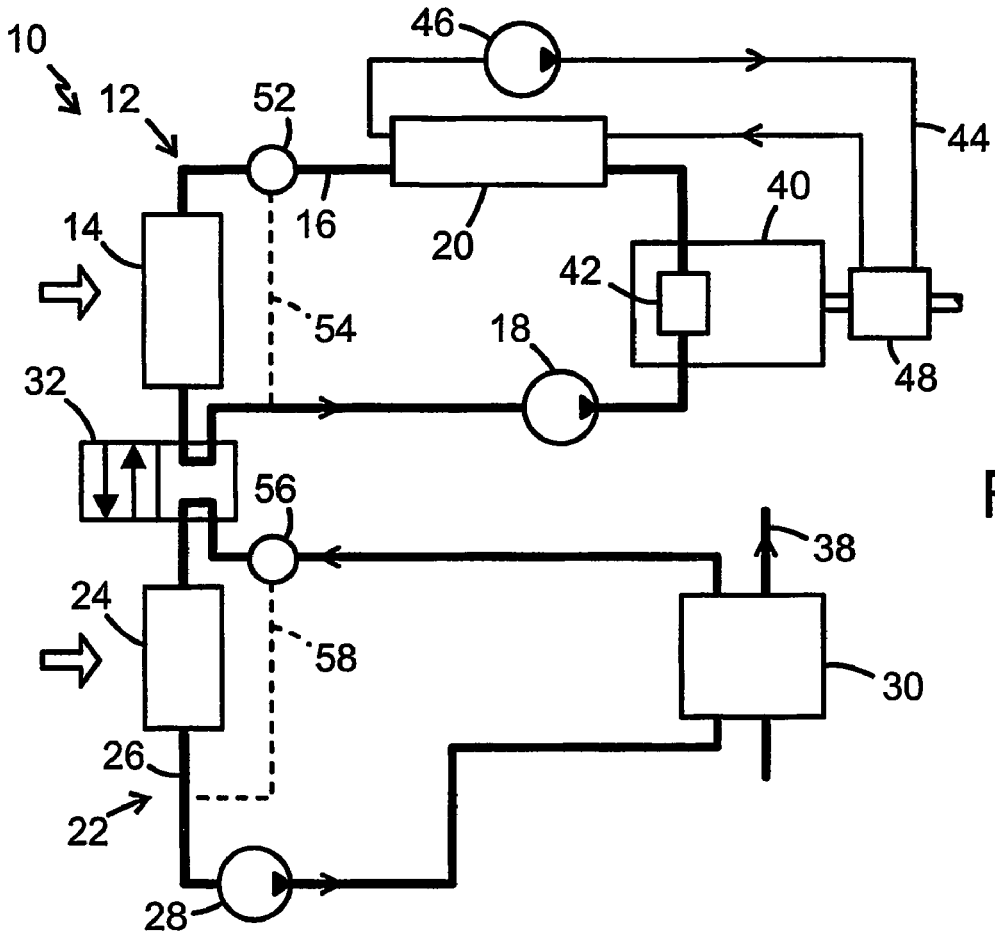
FIG. 1 depicts a block diagram of a cooling device according to the invention, with inactivated retarder.

The block diagram according to FIG. 1 depicts with the general reference notation 10 a cooling device according to the invention for a motor vehicle. The cooling device 10 comprises a first coolant circuit 12 and a second coolant circuit 22.

The first coolant circuit 12 itself comprises a coolant line 16 which connects together in a closed loop a coolant cooler 14, a circulation pump 18, an engine radiator 42 for a vehicle engine 40 and a retarder cooler 20. The retarder cooler 20 is arranged to absorb heat from and thereby cool a fluid supplied by a circulation pump 46 as brake medium to a retarder 48 which is connected mechanically to the vehicle engine 40 and which is of the type well known to those skilled in the art and intended to be used, for example, in heavy freight vehicles.

The second coolant circuit 22 comprises likewise a coolant line 26 which connects together in a closed loop a coolant cooler 24, a circulation pump 28 and a further cooler 30.

In each coolant circuit 12, 22 there are also in a known manner thermostats 52 and 56 which can respectively via lines 54 and 58 regulate the coolant flow in the respective coolant lines 16, 26.

According to the invention, a valve means 32 is arranged to connect the first and second coolant circuits 12, 22 together upon activation of the retarder 48, so that the two coolant coolers 14, 24 are then used for cooling the retarder 48, and to restore an original situation of the coolant circuits 12, 22 upon deactivation of the retarder 48.

Figure 2:
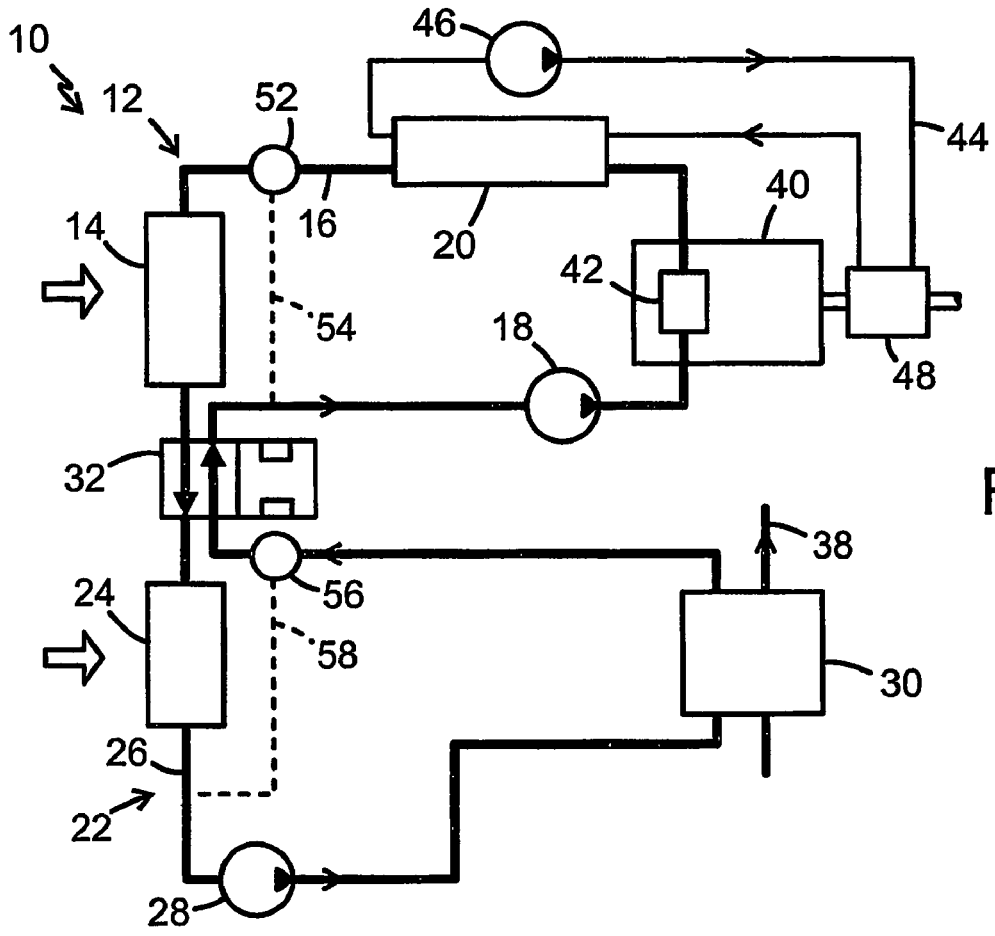
FIG. 2 depicts a block diagram corresponding to FIG. 1, with activated retarder.

This is accomplished in the embodiment depicted in FIGS. 1 and 2 by means of a two-position directional valve 32, e.g. of electromagnetic type, connected to the coolant lines. In the situation according to FIG. 1, the valve 32 assumes its first position whereby the coolant circuits 12, 22 are separated from one another so that coolant circuit 12 cools the engine 40 and the retarder 48 and coolant circuit 22 cools the further cooler 30. In the situation according to FIG. 2, the valve 32 assumes its second position whereby the coolant circuits 12, 22 are connected together to form a single circuit.

When the two circuits are connected together, the temperature will be the same in both circuits. The temperature level will be determined by the power supply from the retarder and, to some extent, by the thermostats. When the circuits are connected together, at least one of the thermostats needs to be bypassed or the set-values need to be actively changed (not depicted).

Figure 3:
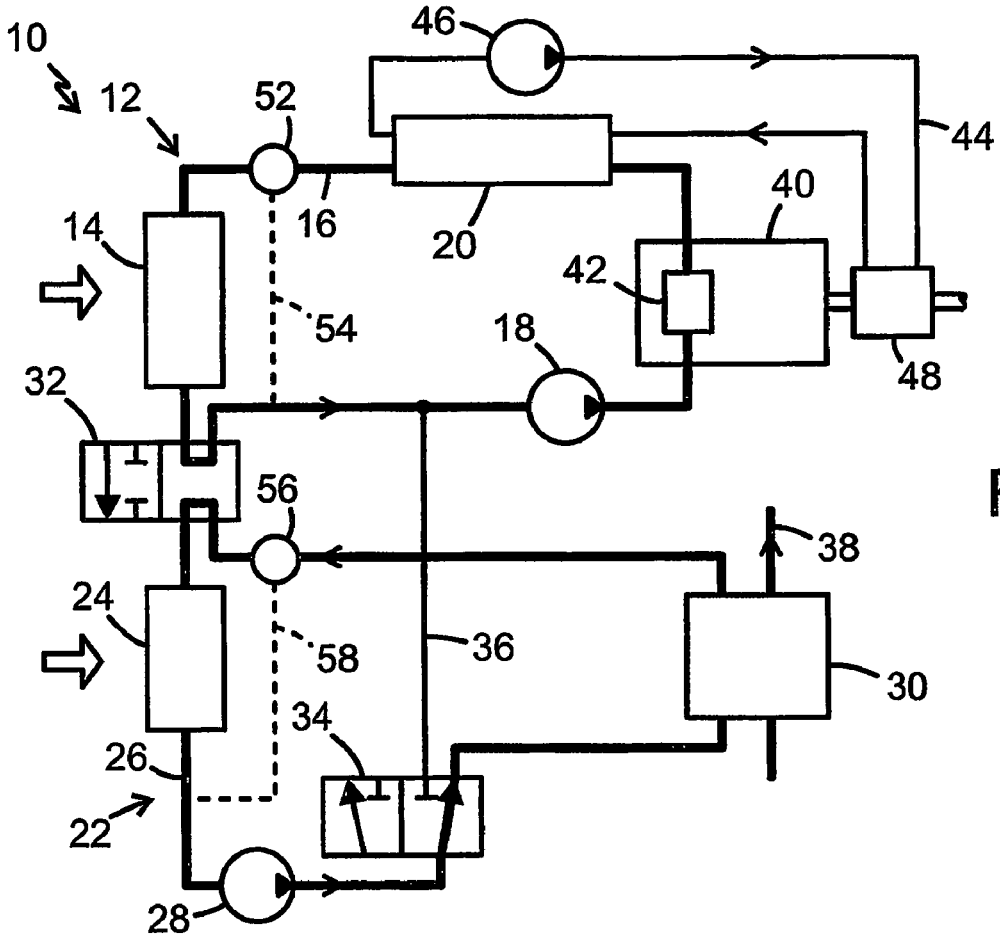
FIG. 3 depicts a block diagram of a cooling device of an alternative embodiment according to the invention, with inactivated retarder.
Figure 4:
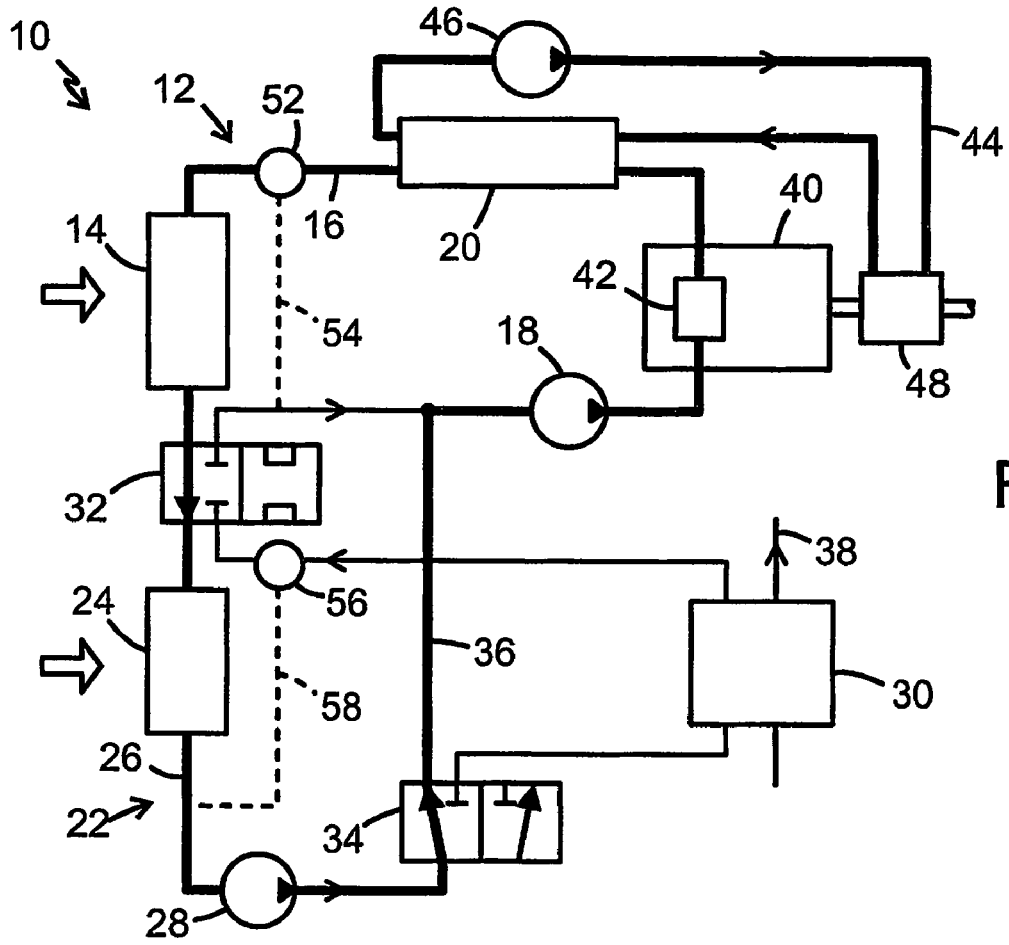
FIG. 4 depicts a block diagram corresponding to FIG. 1, with activated retarder.

According to the alternative embodiment of the invention depicted in FIGS. 3 and 4, two valve means 32, 34 are arranged to disconnect the further cooler 30 from the second coolant circuit 22 and to connect the first and second coolant circuits 12, 22 together upon activation of the retarder 48 so that the two coolant coolers 14, 24 are then used for cooling the retarder 48, and to restore an original situation of the coolant circuits 12, 22 upon deactivation of the retarder 48.

This is accomplished in the alternative embodiment by means of a pair of two-position directional valves 32 and 34, e.g. of electromagnetic type, connected to the coolant lines and intended to be operated simultaneously. In the situation according to FIG. 3, the valves 32, 34 assume their first position whereby the coolant circuits 12, 22 are separated from one another so that coolant circuit 12 cools the engine 40 and the retarder 48 and coolant circuit 22 cools the further cooler 30. In the situation according to FIG. 2, the valves 32, 34 assume their second position whereby, as previously, the coolant circuits 12, 22 are connected together to form a single circuit, while the further cooler 30 is disconnected from this single circuit. Within the scope of the invention it is also possible to integrate the functions of the two valves 32, 34 in a single directional valve (not depicted).

It is also conceivable by means of a bypass line and associated valve arrangement (not depicted) to disconnect also the engine radiator 42 upon activation of the retarder 48.

As also indicated below, another possible alternative is the engine radiator 42 having a cooling circuit of its own (not depicted).

Figure 5:
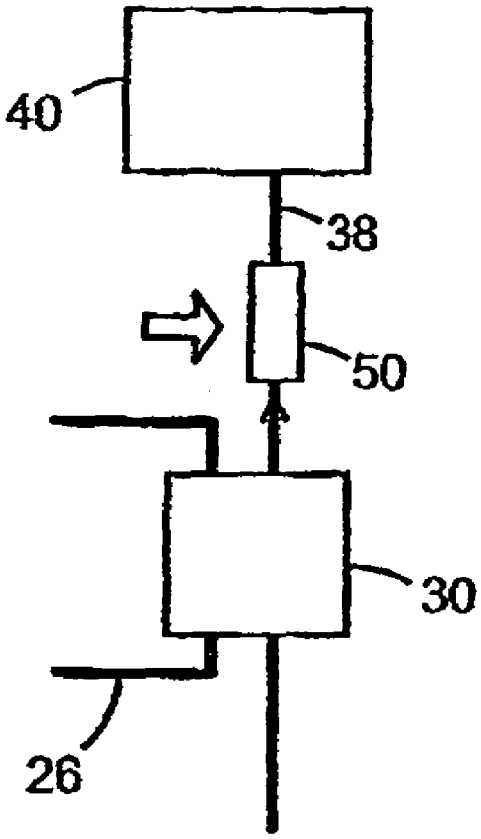
FIG. 5 depicts part of a coolant circuit corresponding to FIG. 1, with a cooler in the form of a charge air cooler.

The further cooler 30 in the embodiment according to FIG. 5 is a charge air cooler for fresh air for the engine 40 in a fresh air line 38. If so required, there may also be in the line 38 an extra charge air cooling stage in the form of an air/air heat exchanger 50 situated suitably (in a manner not depicted) at the front of the vehicle, as also the two coolant coolers 14, 24.

Figure 6:
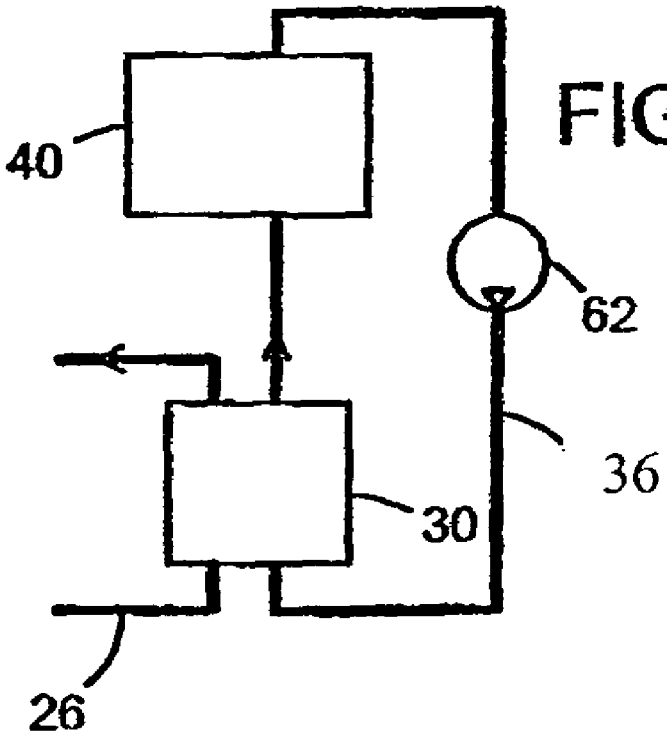
FIG. 6 depicts part of a coolant circuit corresponding to FIG. 1, with a general cooler such as an EGR cooler or motor oil cooler.

In the embodiment according to FIG. 6, the further cooler 30 is schematically shown arranged for cooling an engine fluid via a closed line 36 with a pump or compressor 62. As previously indicated, the cooled engine fluid may be EGR gas or motor oil.

Although the invention is described in the foregoing in connection with only two coolant loops, it is also possible within the scopes of the ensuing claims for two or more separate coolant loops to be connected together to cool the retarder. For example, it is conceivable to arrange, in addition to the retarder cooler 20, separate coolant circuits with their own coolant coolers for charge air, EGR gas, engine coolant and motor oil, which coolant coolers are therefore disconnected upon activation of the retarder 48 (not depicted).

The invention claimed is:

1. A cooling device for a retarder of a vehicle engine, comprising a first coolant circuit having a first coolant cooler and a retarder cooler in the first circuit;

at least one further coolant circuit having a further coolant cooler and a further cooler therein;

a valve connected into the first and the further coolant circuits and operable to connect the first and further coolant circuits together upon activation of the retarder so that at least the first and further coolant coolers are connected for cooling the retarder, and operable to disconnect the first and further coolant circuits from one another so that they revert to being separate coolant circuits upon deactivation of the retarder.

2. A cooling device according to claim 1, further comprising:

a further valve operable to disconnect the further cooler from the further coolant circuit upon activation of the retarder and to connect the further cooler to the further coolant circuit upon deactivation of the retarder.

3. A cooling device according to claim 1, wherein the valve comprises a first directional valve operable between the connect and disconnect positions.

4. A cooling device according to claim 1, wherein the first coolant circuit also comprises an engine radiator.

5. A cooling device according to claim 4, wherein the further cooler comprises at least one cooler selected from the group consisting of a charge air cooler, an EGR cooler and a motor oil cooler.

6. A method of cooling a retarder of a vehicle engine with a cooling device comprising a first coolant circuit including a coolant cooler and a retarder cooler and comprising at least one further coolant circuit including a further coolant cooler and a further cooler, the method comprising:

connecting the coolant circuits together upon activation of the retarder so that at least the first and further coolant coolers are operable for cooling the retarder; and disconnecting the mutually connected first and further coolant circuits from one another so that they revert to being separate circuits upon deactivation of the retarder.

7. A method according to claim 6, further comprising disconnecting the further cooler from the further coolant circuit upon activation of the retarder; and connecting the further cooler to the further coolant circuit upon deactivation of the retarder.

8. In combination, a motor vehicle engine including a radiator of the engine, and a retarder operable for retarding the vehicle engine, in combination with the cooling device of claim 1, wherein the engine radiator is in the first coolant circuit.

* * * * *